US008616553B1

(12) United States Patent
Tsai et al.

(10) Patent No.: US 8,616,553 B1
(45) Date of Patent: Dec. 31, 2013

(54) BASKETBALL GAME ASSEMBLY WITH BALL BLOCKING DEVICE

(71) Applicants: Feiloli Electronic Co., Ltd, Changhua County (TW); Department of Electrical Engineering,National Changhua University of Education, Changhua (TW)

(72) Inventors: Chi-Ming Tsai, Changhua County (TW); I-Chiang Yang, Changhua County (TW); Wen-Ren Yang, Taichung (TW); Tsair-Rong Chen, Changhua County (TW)

(73) Assignees: Feiloli Electronic Co., Ltd., Hemei Town, Changhua County (TW); Department of Electrical Engineering, National Changhua University of Education, Changhua (TW)

( * ) Notice: Subject to any disclaimer, the term of this patent is extended or adjusted under 35 U.S.C. 154(b) by 0 days.

(21) Appl. No.: 13/672,694

(22) Filed: Nov. 8, 2012

(51) Int. Cl.
*A63F 7/20* (2006.01)

(52) U.S. Cl.
USPC ..... 273/317.3

(58) Field of Classification Search
USPC ..... 273/317, 317.1, 317.3; 473/479, 481
See application file for complete search history.

(56) References Cited

U.S. PATENT DOCUMENTS

| | | | | |
|---|---|---|---|---|
| 5,480,147 | A * | 1/1996 | Ethier et al. | 273/317.3 |
| 6,536,770 | B1 * | 3/2003 | Yang | 273/317.3 |
| 6,918,591 | B2 * | 7/2005 | D'Amico et al. | 273/317.3 |
| 7,404,562 | B2 * | 7/2008 | Chen et al. | 273/317.3 |
| 2004/0160011 | A1 * | 8/2004 | Fitzgerald | 273/317.3 |
| 2012/0142458 | A1 * | 6/2012 | He et al. | 473/480 |

* cited by examiner

*Primary Examiner* — Raleigh W Chiu

(57) ABSTRACT

A basketball game assembly includes a backboard, a hoop mounted on a front side of the backboard and a ball blocking device. The ball blocking device includes a shaft, a blocking member and a driving arrangement. The shaft at its rear end is rotatably mounted to the backboard. The blocking member is connected to a front end of the shaft and disposed adjacent to a front edge of the hoop. The driving arrangement is configured to rotate the shaft so as to have the blocking member move to a blocking position higher than the hoop or depart from the blocking position.

7 Claims, 6 Drawing Sheets

BASKETBALL GAME ASSEMBLY WITH BALL BLOCKING DEVICE

BACKGROUND OF THE INVENTION

1. Field of the Invention

The present invention relates to a basketball game assembly and more particularly to a basketball game assembly with a ball blocking device to increase the difficulty of the game.

2. Description of the Related Art

Arcade type basketball game assemblies which test the shooting skill of an individual are a popular form of entertainment for people of all ages. As shown in FIG. 6, a conventional basket game assembly 1 which generally includes a hoop 11, an inclined hopper 12 and a ball blocking device 13 to prevent balls from entering the hoop 11. Specifically, the ball blocking device 13 includes a blocking member 15 standing on the hopper 12 and a drive mechanism 14 configured to drive the blocking member 15 to swing back and forth. In this way, the ball blocking device 13 can obstruct the ball shooting and therefore increase the difficulty of the game.

SUMMARY OF THE INVENTION

It is an objective of the present invention to provide a basketball game assembly with a unique ball blocking device to increase the difficulty of the ball shooting.

To achieve the foregoing objective, the basketball game assembly includes a backboard, a hoop and the ball blocking device. The hoop is mounted on a front side of the backboard. The ball blocking device includes a shaft, a blocking member and a driving arrangement. The shaft at its rear end is rotatably mounted to the backboard. The blocking member is connected to a front end of the shaft and disposed adjacent to a front edge of the hoop. The driving arrangement is configured to rotate the shaft so as to have the blocking member move to a blocking position higher than the hoop or depart from the blocking position. In this way, the ball will be blocked out from entering into the hoop as the blocking member is in blocking position.

Preferably, the driving arrangement is disposed on a rear side of the backboard and includes a motor and a linkage mechanism. The linkage mechanism and the shaft cooperate to transform rotary motion of the motor into oscillating motion of the blocking member in an arc to have the blocking member move to or depart from the blocking position.

In comparison to the prior art mentioned above, the blocking member of the present invention is positioned right in front of the hoop so the distance between the blocking member and the player is relatively longer and therefore shooting of a ball into the hoop becomes harder. Moreover, the blocking member is configured to swing up and down, which prompts the player to practice more about how to control the ball's height for the ball shooting.

Further benefits and advantages of the present invention will become apparent after a careful reading of the detailed description with appropriate reference to the accompanying drawings.

BRIEF DESCRIPTION OF THE DRAWINGS

A basketball game assembly according to the invention will now be described, by way of example, with reference to the accompanying drawings, in which.

DETAILED DESCRIPTION OF PREFERRED EMBODIMENT

Figure 1:
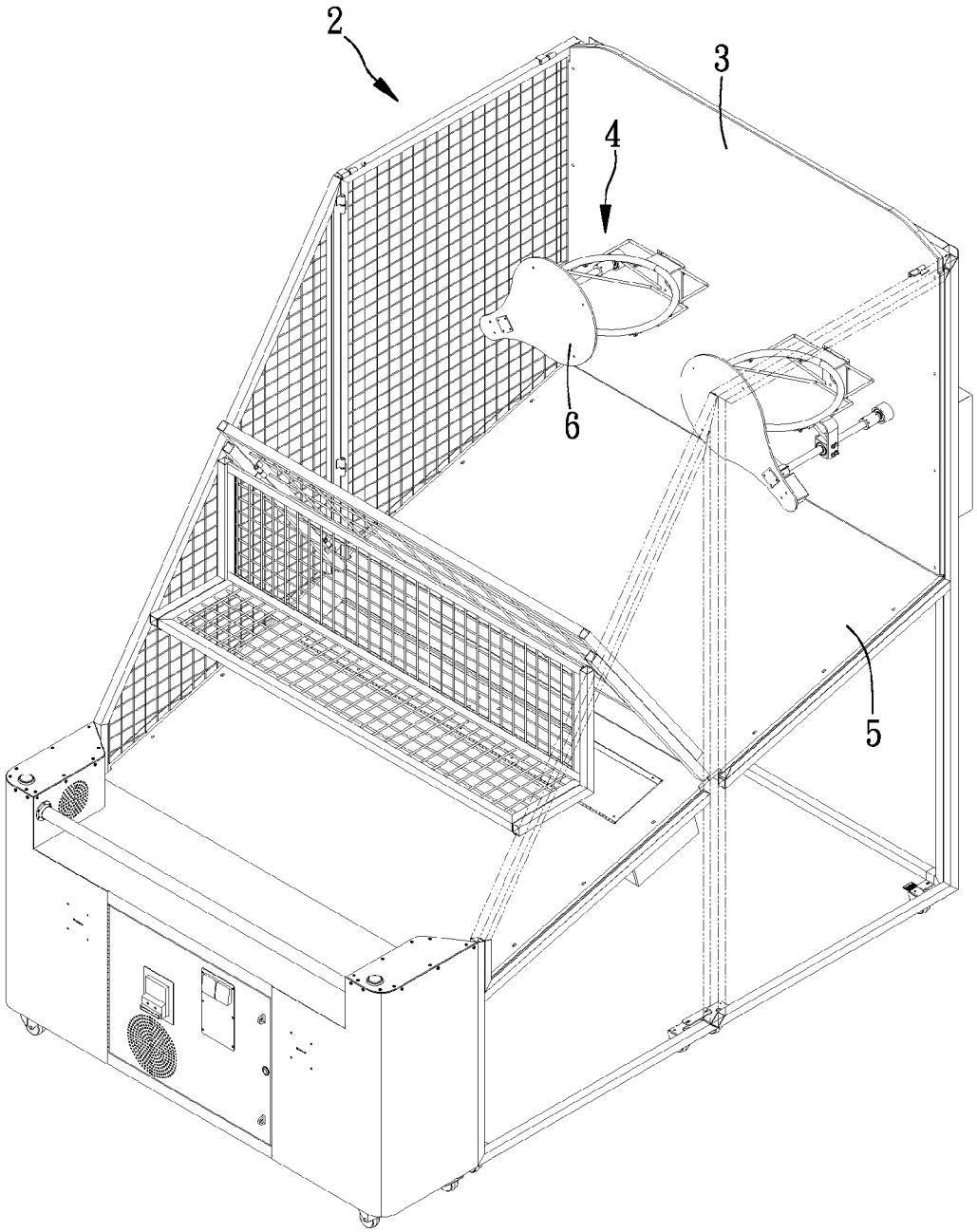
FIG. 1 is an isometric view of the basketball game assembly.

Referring to the drawings and initially to FIGS. 1-5, a basketball game assembly 2 is provided in accordance with the preferred embodiment of the present invention. As shown in FIG. 1, the basketball game assembly 2 includes a backboard 3, a hoop 4 mounted on a front side of the backboard 3, an inclined hopper 5 and a ball blocking device 6 for blocking balls from entering the hoop 4 at intervals.

Figure 2:
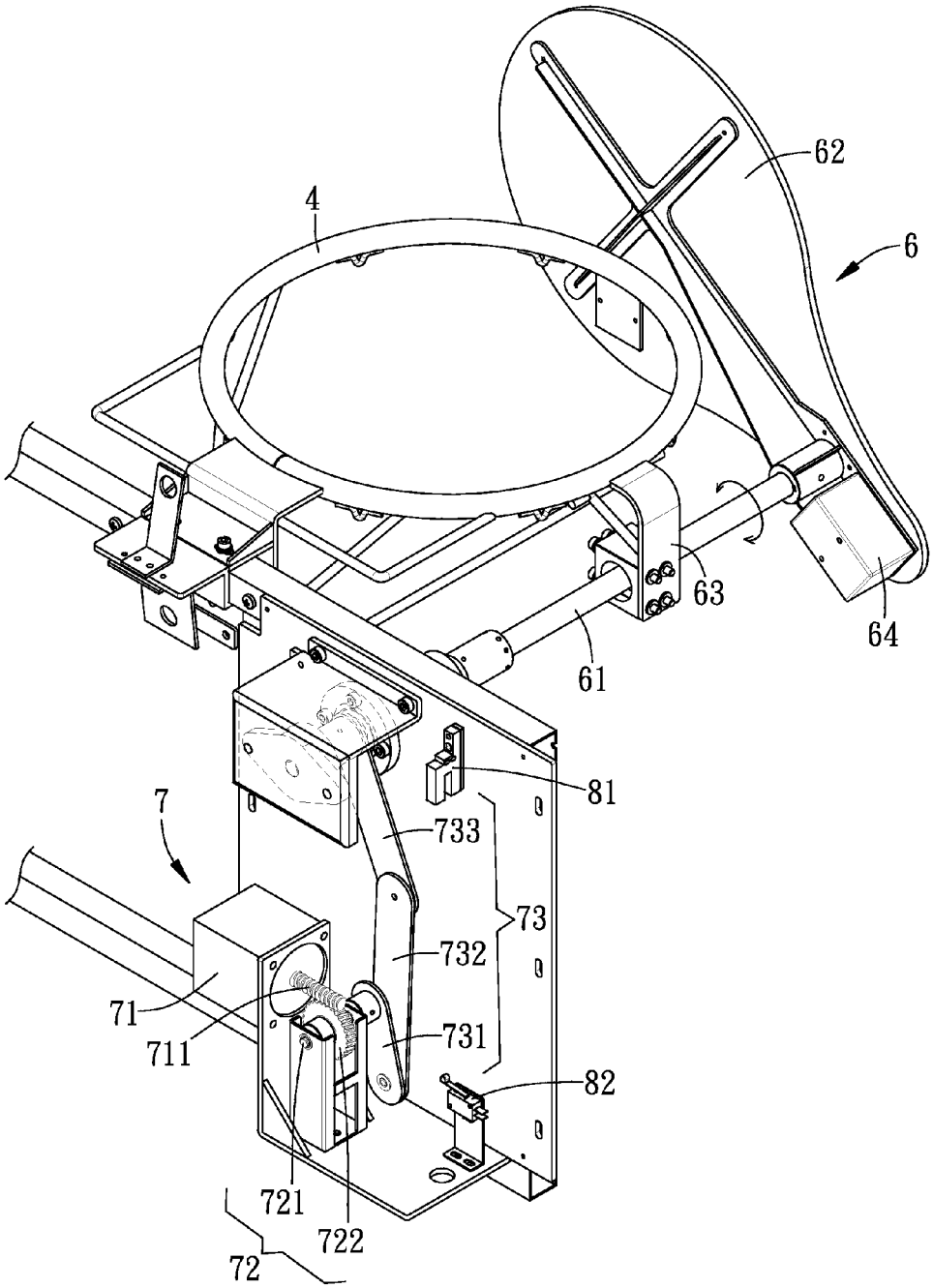
FIG. 2 is a fragmentary enlarged isometric view of the basketball game assembly to show a rear side of the assembly.
Figure 3:
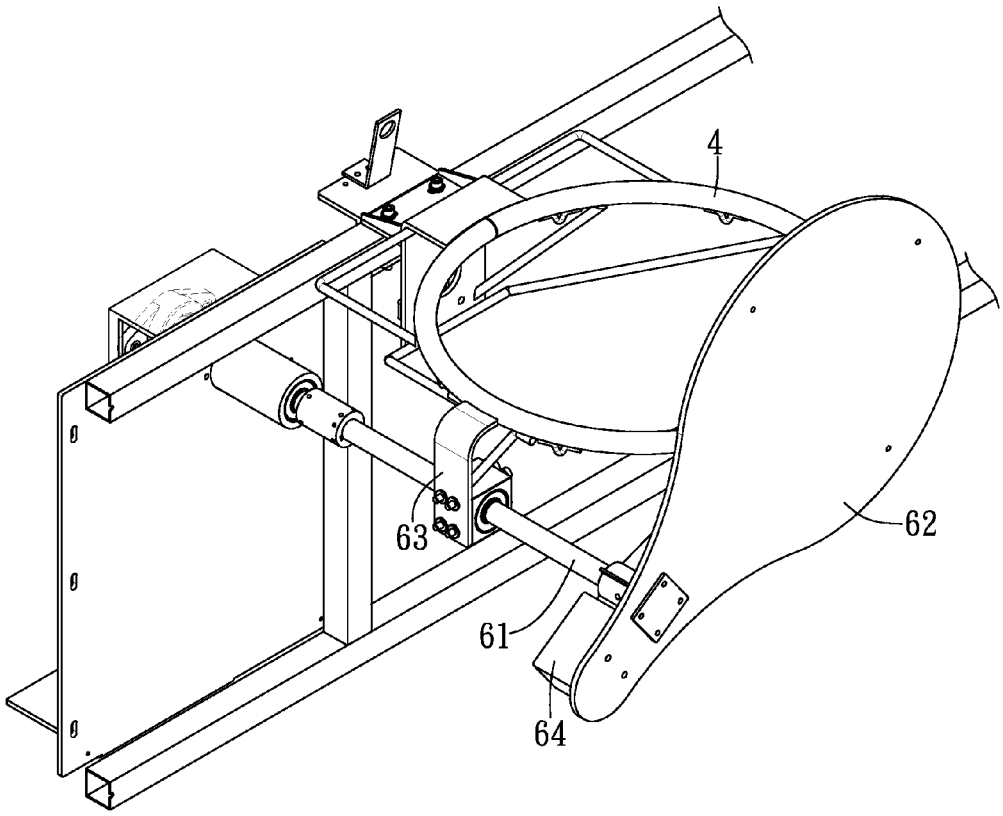
FIG. 3 is a fragmentary enlarged isometric view of the basketball game assembly, from another angle, to show a front side of the assembly.

Referring to FIGS. 1 and 2, the ball blocking device 6 includes a horizontal shaft 61, a blocking member 62 and a driving arrangement 7. The shaft 61 at its rear end is rotatably mounted to the backboard 3. The blocking member 62, such as a baffle, is connected to a front end of the shaft and is disposed adjacent to a front edge of the hoop 4, as shown in FIG. 3. In addition, the ball blocking device 6 further includes a bracket 63 and a balance weight 64. The bracket 63 has one end fixed to the hoop 4 and the other end holding the shaft 61. The balance weight 64 is provided to counterbalance the blocking member 62, and for this reason the balance weight 64 and the blocking member 62 are substantially disposed at opposite sides of the shaft 61.

The driving arrangement 7 is configured to rotate the shaft 61 so as to have the blocking member 62 swing up to a blocking position (see FIG. 4) higher than the hoop 4 or swing back from the blocking position (see FIG. 5), thereby interfering balls from entering the hoop 4 at intervals. Specifically, as shown in FIG. 2, the driving arrangement 7 is disposed at a rear side of the backboard 3 and includes a motor 71, a worm-gear speed reducer 72 and a linkage mechanism 73. The worm-gear speed reducer 72 includes a spindle 721 and a worm wheel 722 mounted around the spindle 721. The motor 71 has a worm shaft 711 adapted to mate with the worm wheel 722 of the speed reducer 72 to rotate the spindle 721. The linkage mechanism 73 is a crank-rocker mechanism which includes a crank 731 driven by the spindle 721, a rocker arm 733 mounted on the rear end of the shaft 61 and a coupler 732 connecting the crank 731 and the rocker arm 733. In this way, the shaft 61 can be driven by the driving arrangement 7 to rotate in an arc.

Figure 4:
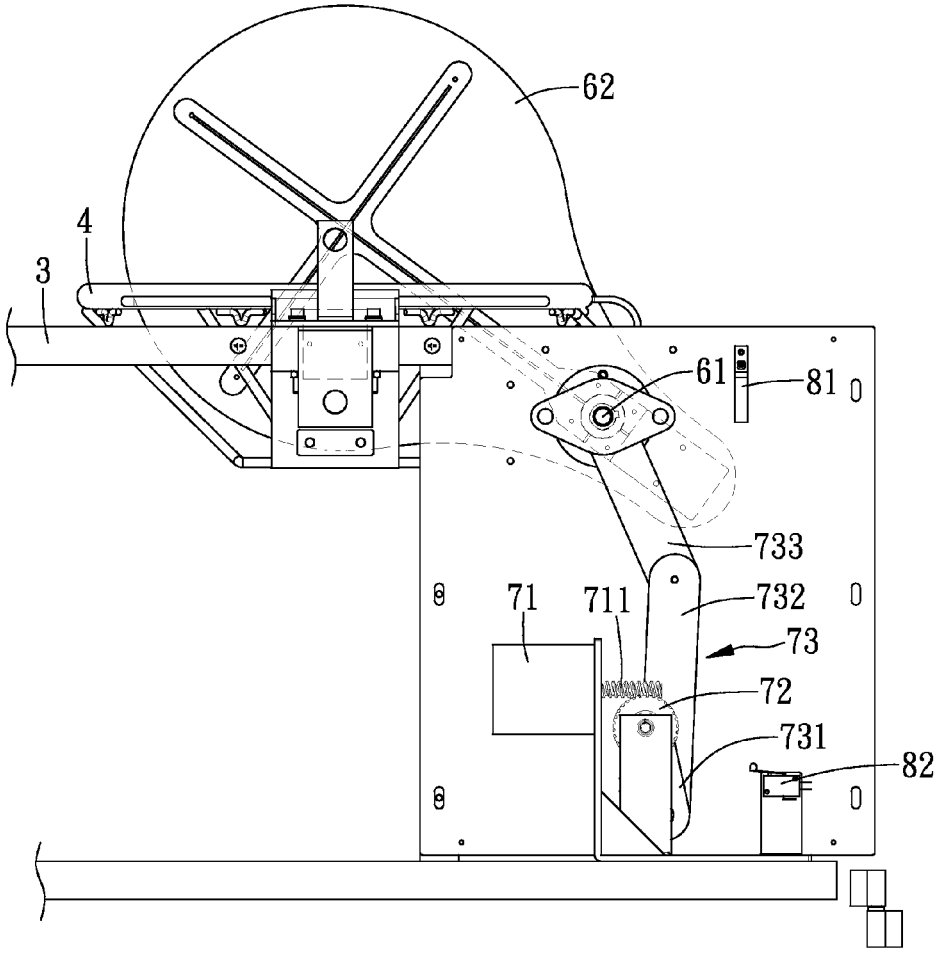
FIG. 4 is a fragmentary rear view of the basketball game assembly shown in FIG. 2, showing that a blocking member (62) is in a blocking position.
Figure 5:
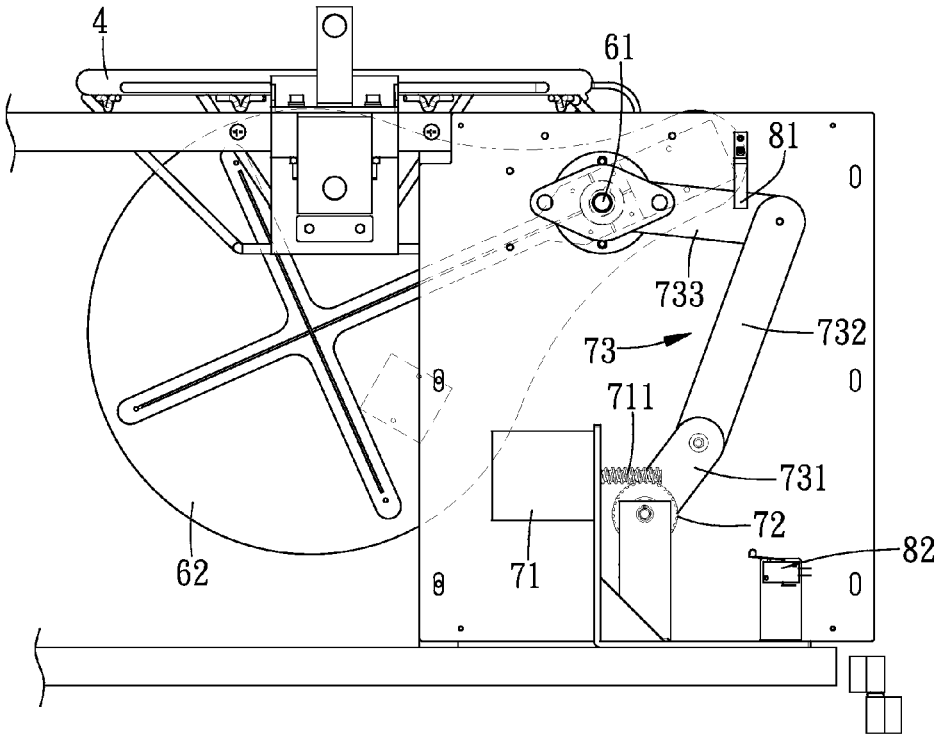
FIG. 5 is a view similar to FIG. 4, showing the blocking member is in a releasing position.

In other words, as shown in FIGS. 4 and 5, the linkage mechanism 73 has one end joined to the motor 71 via the speed reducer 72, and the other end joined to the shaft 61 such that the linkage mechanism 73 and the shaft 61 cooperate to transform rotary motion of the motor 71 into oscillating motion of the blocking member 62 in an arc. In this way, the blocking member 62 can swing up and down at intervals to interfere the ball from entering the hoop 4.

It is noted that a light sensor 81 may be included and disposed on a route along which the rocker arm 733 travels. The light sensor 81 can be used to count the number of times the rocker arm 733 oscillates and therefore the blocking member 62 blocks the balls. Moreover, a mechanical sensor 82 may be included and disposed on a route along which the crank 731 travels so as to detect if the crank 731 rotates normally and further to know if the motor 71 functions well.

Figure 6:
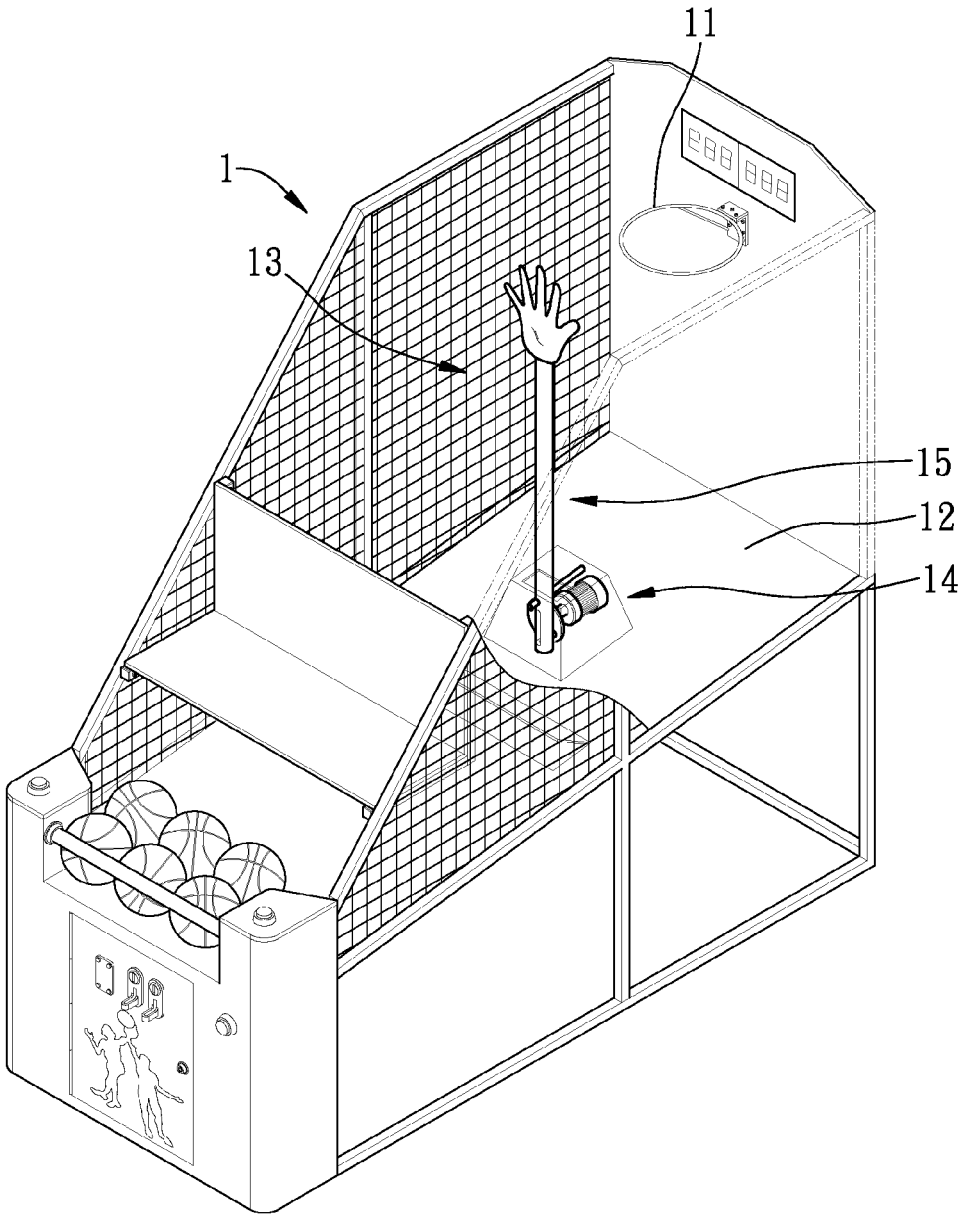
FIG. 6 PRIOR ART
FIG. 6 is a prior art.

In comparison to the prior art of FIG. 6, the blocking member 62 of the present invention is positioned right in front of the hoop 4 so the distance between the blocking member 62 and the player is relatively longer and therefore shooting of a ball into the hoop becomes harder. Moreover, the blocking member 62 can swing up and down, which prompts the player to practice more about how to control the ball's height for the ball shooting.

It is to be understood that the disclosed embodiments are illustrative in nature and the invention is not to be limited to any one or more embodiments except as set forth in the following claims.

What is claimed is:

1. A basketball game assembly comprising:

a backboard;

a hoop mounted on a front side of the backboard;

a ball blocking device including a shaft, a blocking member and a driving arrangement; the shaft at its rear end being rotatably mounted to the backboard; the blocking member being connected to a front end of the shaft and disposed adjacent to a front edge of the hoop; and the driving arrangement configured to rotate the shaft so as to have the blocking member move to a blocking position higher than the hoop or depart from the blocking position.

2. The basketball game assembly of claim 1, wherein the ball blocking device further includes a bracket with one end fixed to the hoop and the other end holding the shaft.

3. The basketball game assembly of claim 1, wherein the ball blocking device further includes a balance weight, and the balance weight and the blocking member are substantially disposed at opposite sides of the shaft.

4. The basketball game assembly of claim 1, wherein the driving arrangement is disposed at a rear side of the backboard and includes a motor and a linkage mechanism; and the linkage mechanism and the shaft cooperate to transform rotary motion of the motor into oscillating motion of the blocking member in an arc to have the blocking member move to or depart from the blocking position.

5. The basketball game assembly of claim 4, wherein the driving arrangement further includes a worm-gear speed reducer having a spindle and a worm wheel mounted around the spindle; the motor has a worm shaft adapted to mate with the worm wheel of the reducer to rotate the spindle; the linkage mechanism is a crank-rocker mechanism which includes a crank driven by the spindle, a rocker arm mounted on the rear end of the shaft, and a coupler connecting the crank and the rocker arm.

6. The basketball game assembly of claim 5, wherein the driving arrangement further includes a light sensor disposed on a route along which the rocker arm travels.

7. The basketball game assembly of claim 5, wherein the driving arrangement further includes a mechanical sensor disposed on a route along which the crank travels.

* * * * *